US005970883A

United States Patent [19]

Nast

[11] Patent Number: 5,970,883

[45] Date of Patent: Oct. 26, 1999

[54] LINK TILT DEVICE AND A LINK TILT BOGIE

[75] Inventor: Jean-Daniel Nast, Paris, France

[73] Assignee: GEC Alsthom Transport SA, Paris, France

[21] Appl. No.: 08/977,068

[22] Filed: Nov. 24, 1997

[30] Foreign Application Priority Data

Nov. 25, 1996 [FR] France ..... 96 14370

[51] Int. Cl.[6] ..... B61D 1/00

[52] U.S. Cl. ..... 105/164; 105/199.1; 105/199.2; 105/453

[58] Field of Search ..... 105/164, 179, 105/199.1, 199.2, 200, 201, 453

[56] References Cited

U.S. PATENT DOCUMENTS

| | | | |
|---|---|---|---|
| 2,874,647 | 2/1959 | Candlin, Jr. | 105/453 |
| 3,628,465 | 12/1971 | Dobson | 105/199.1 |
| 3,653,331 | 4/1972 | Chierici | 105/199.2 |
| 5,222,440 | 6/1993 | Schneifer | 105/453 |
| 5,255,611 | 10/1993 | Schneider | 105/453 |

FOREIGN PATENT DOCUMENTS

| | | |
|---|---|---|
| 0189382A2 | 7/1988 | European Pat. Off. . |
| 1549521 | 12/1968 | France . |
| 2102922 | 4/1972 | France . |
| 2001282 | 7/1970 | Germany . |
| 4423636A1 | 1/1996 | Germany . |

*Primary Examiner*—Robert J. Oberleitner
*Assistant Examiner*—Robert McCarry
*Attorney, Agent, or Firm*—Sughrue, Mion, Zinn, Macpeak & Seas, PLLC

[57] ABSTRACT

The present invention relates to a link tilt device for a tilting cross-member suitable for being disposed in a bogie frame in such a manner as to be suspended from the bogie frame by means of the links, secondary suspensions being disposed between the tilting cross-member and the vehicle body, wherein the middle cross-members of the bogie frame, the links, and the tilting cross-member form an assembly such that the angular stiffness between the bogie frame and said vehicle body is a characteristic that is predetermined.

6 Claims, 4 Drawing Sheets

PRIOR ART

LINK TILT DEVICE AND A LINK TILT BOGIE

The present invention relates in general to vehicles having bogies that provide tilt compensation for insufficient cant, and more particularly it relates to a link tilt device and to a link tilt bogie.

BACKGROUND OF THE INVENTION

Document DE 43 43 998 relates to connections between the bogies and the frame of a rail vehicle.

FIG. 1 of that prior art document shows a rail vehicle whose bogie provides tilt compensation for insufficient cant by applying a list angle to a tilting cross-member, and thus to the body of the vehicle.

Such tilt compensation is obtained by means of a link tilt device.

The prior art link tilt device has a tilting cross-member disposed in a bogie frame and suspended by means of links.

The tilt movement between the tilting cross-member and the bogie frame is obtained by the presence of a ball joint at each link end.

As described in the prior art, primary suspensions are disposed between the bogie frame and the axle boxes, and secondary suspensions are disposed between the tilting cross-member and the body of the vehicle.

In such a prior art link tilt device, drive forces between the bogie frame and the body of the vehicle are taken up by the links.

In accordance with the teaching of the state of the art, anti-yaw dampers are preferably disposed between the bogie frame and the vehicle body.

The anti-yaw dampers disposed in this way are subjected to displacements due to the inclination between the bogie frame and the vehicle body.

A drawback of the above lies in the anti-yaw dampers not remaining constantly parallel to the secondary suspensions with which they are associated.

During tilt compensation, and thus because the body is then subject to a list angle, the displacement due to the tilt between the vehicle body and the tilting cross-member gives rise to a horizontal force.

A drawback due to that horizontal force is the appearance of coupling of the anti-yaw coupling forces between the vehicle body and the bogie during tilt compensation.

Another drawback of the prior art link tilt device is that yaw couples are taken up by the tilting cross-member because it comes into abutment against the bogie frame.

From the above it results that the angular stiffness between the bogie frame and the vehicle body is random.

OBJECTS AND SUMMARY OF THE INVENTION

Thus, an object of the invention is to provide a link tilt device and a link tilt bogie that do not suffer from the drawbacks of prior art link tilt devices and prior art link tilt bogies.

The invention provides a link tilt device for a tilting cross-member suitable for being placed in a bogie frame in such a manner as to be suspended from said bogie frame by means of said links, secondary suspensions being disposed between said tilting cross-member and said vehicle body, said links, said tilting cross-member, and said bogie frame forming, in the radial plane, a trapezium of hinged rigid elements having a short base secured to the tilting cross-member, a long base secured to said bogie frame and having sloping sides constituted by said links, said links being disposed obliquely and converging, wherein the middle cross-members of said bogie frame, said links, and said tilting cross-member form an assembly such that the angular stiffness between said bogie frame and said vehicle body is a characteristic that is predetermined.

According to a characteristic of the invention, said angular stiffness between said bogie frame and said vehicle body is a characteristic which is predetermined because each link includes at its top end a top bearing associated with a first reception element for said top bearing that is made in a middle cross-member of said bogie frame, and at its bottom end a bottom bearing associated with a second reception element for said bottom bearing made in said tilting cross-member.

The link tilt device of the invention also satisfies at least one of the following characteristics:

- anti-yaw dampers are disposed between said vehicle body and said tilting cross-member, parallel to said secondary suspensions with which they are associated;
- an intermediate cross-member is disposed between the secondary suspensions of the vehicle body and the tilting cross-member in such a manner as to support said secondary suspensions, a friction block type element being disposed between said intermediate cross-member and said tilting cross-member; and
- an element for controlling tilt compensation for insufficient cant is secured to said tilting cross-member and to said bogie frame.

According to the invention, the link tilt bogie includes a link tilt device according to any of the previous characteristics.

An advantage of the link tilt device and the link tilt bogie of the invention is that the angular stiffness between the bogie frame and the vehicle body is a characteristic that is predetermined because bearings are provided at the ends of the links.

Another advantage of the link tilt device and of the link tilt bogie of the invention is that it is possible to provide clearance between the tilting cross-member and the bogie frame.

Another advantage of the link tilt device and of the link tilt bogie of the invention is that it is possible to provide the anti-yaw dampers between the vehicle body and the tilting cross-member, in a first embodiment of the invention.

Such an embodiment is possible because, as mentioned above, the angular stiffness between the bogie frame and the vehicle body is a characteristic that is predetermined in the context of the invention, unlike in the context of the prior art.

In such a disposition, the anti-yaw dampers are no longer subjected to displacement associated with inclination between the bogie chassis and the vehicle body.

From the above, it results that there is no coupling of anti-yaw coupling forces between the vehicle body and the bogie while tilt compensation is taking place.

In another embodiment, another advantage of the link tilt device and of the link tilt bogie of the invention is that it is possible to provide friction blocks between the vehicle body and the tilting cross-member.

Such an embodiment is also possible because, as mentioned above, the angular stiffness between the bogie frame and the vehicle body is a characteristic that is predetermined, in the context of the invention.

BRIEF DESCRIPTION OF THE DRAWINGS

Other objects, characteristics, and advantages of the invention appear on reading the following description of the preferred embodiment of the tilt link device and of the tilt link bogie, which description is given with reference to the accompanying drawings, in which.

MORE DETAILED DESCRIPTION

Figure 1:
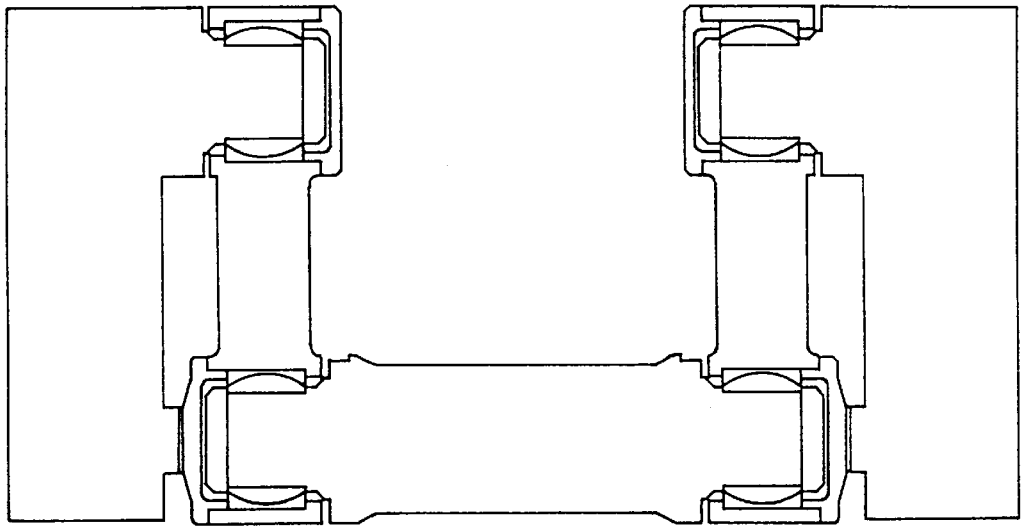
FIG. 1 is a side view in section of a prior art link tilt device.

FIG. 1 is a side view in section of a prior art link tilt device.

In such a prior art device, the bogie provides tilt compensation for insufficient cant by applying a list angle to a tilting cross-member, and thus to the vehicle body.

The prior art link tilt device includes a tilting cross-member disposed in a bogie frame and suspended by means of links.

The tilting movement between the tilting cross-member and the bogie frame is obtained because of the presence of ball joints at each link end.

Figure 2:
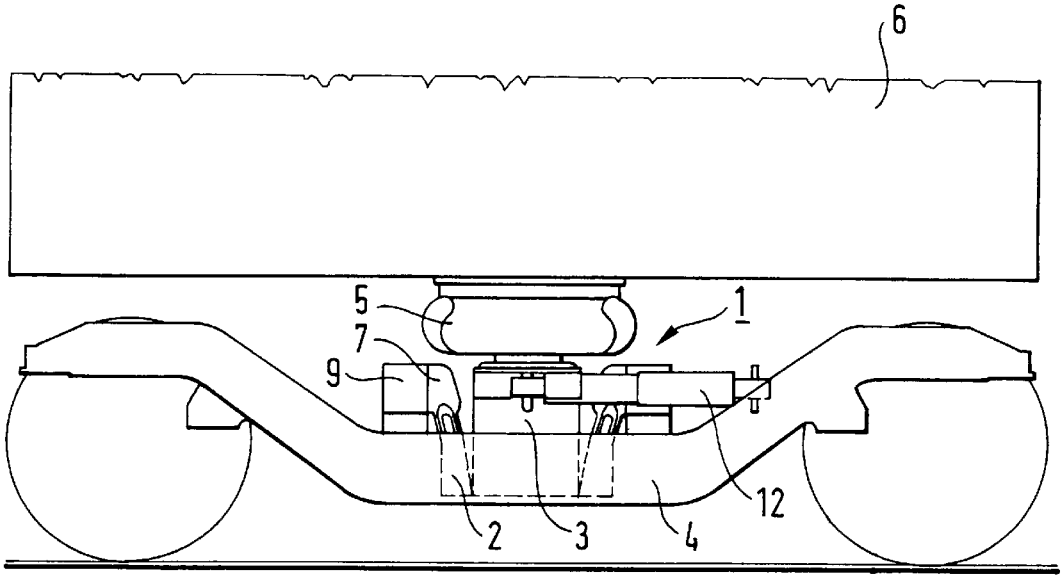
FIGS. 2 and 3 are respectively a side view and a plan view of a link tilt bogie constituting a first embodiment of the invention.
Figure 3:
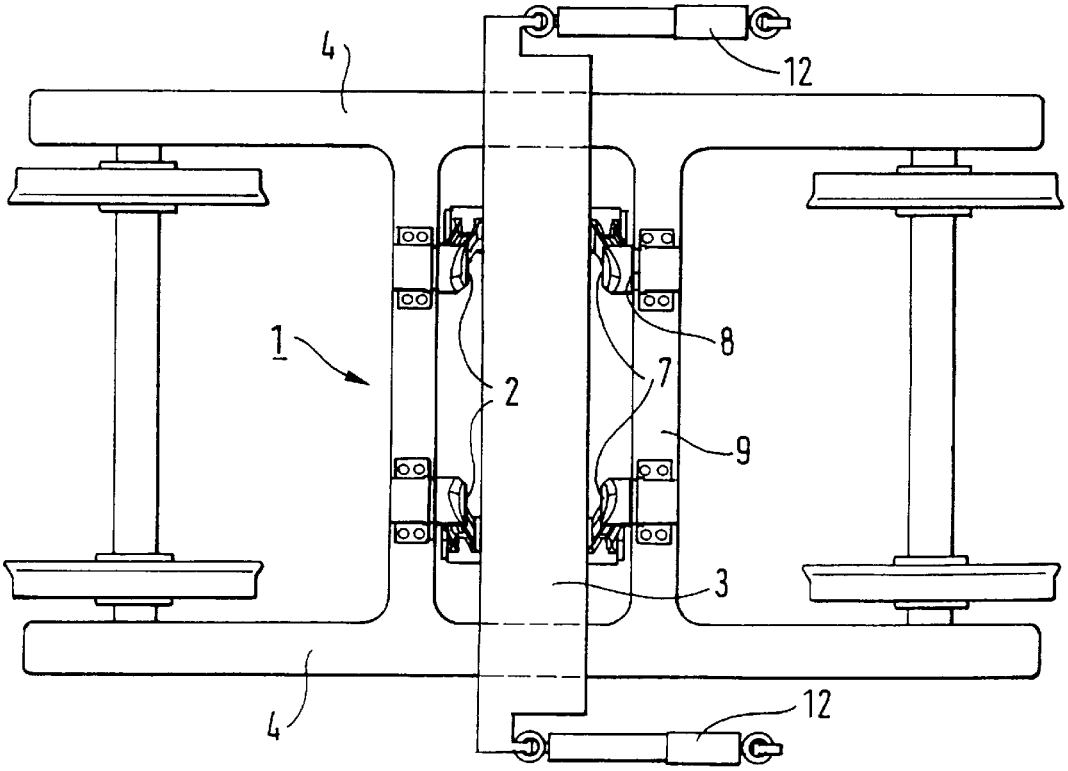

FIGS. 2 and 3 are respectively a side view and a plan view of a link tilt bogie constituting a first embodiment of the invention.

The link tilt device 1 of the invention has links 2 and is associated with a tilting cross-member 3.

The tilting cross-member 3 can be disposed in a bogie frame 4 so as to be suspended from the bogie frame 4 by the links 2.

Secondary suspensions 5 are disposed between the tilting cross-member 3 and the vehicle body 6.

The links 2, the tilting cross-member 3, and the bogie frame 4 constitute, in the radial plane of the bogie frame, a hinged trapezium of rigid elements with the short base being secured to the tilting cross-member 3 and the long base being secured to the bogie frame 4, and with the sloping sides being constituted by the links 2.

The links 2 are disposed obliquely and they converge.

According to an essential characteristic of the link tilt device 1 of the invention, the middle cross-members 9 of the bogie frame 4, the links 2, and the tilting cross-member 3 form an assembly such that the angular stiffness between the bogie frame 4 and the vehicle body 6 is a characteristic that is predetermined.

For this purpose, and by way of example, each link 2 includes, at its top end, a top bearing 7 associated with a first bearing reception element 8 for the top bearing, and at its bottom end a bottom bearing 10 associated with a second reception element 11 for the bottom bearing 10.

The first reception element 8 for the top bearings 7 are implemented in front and back middle cross-members 9 of the bogie frame 4.

The second reception elements 11 for the bottom bearings 10 are implemented in the tilting cross-member 3.

Figure 4:
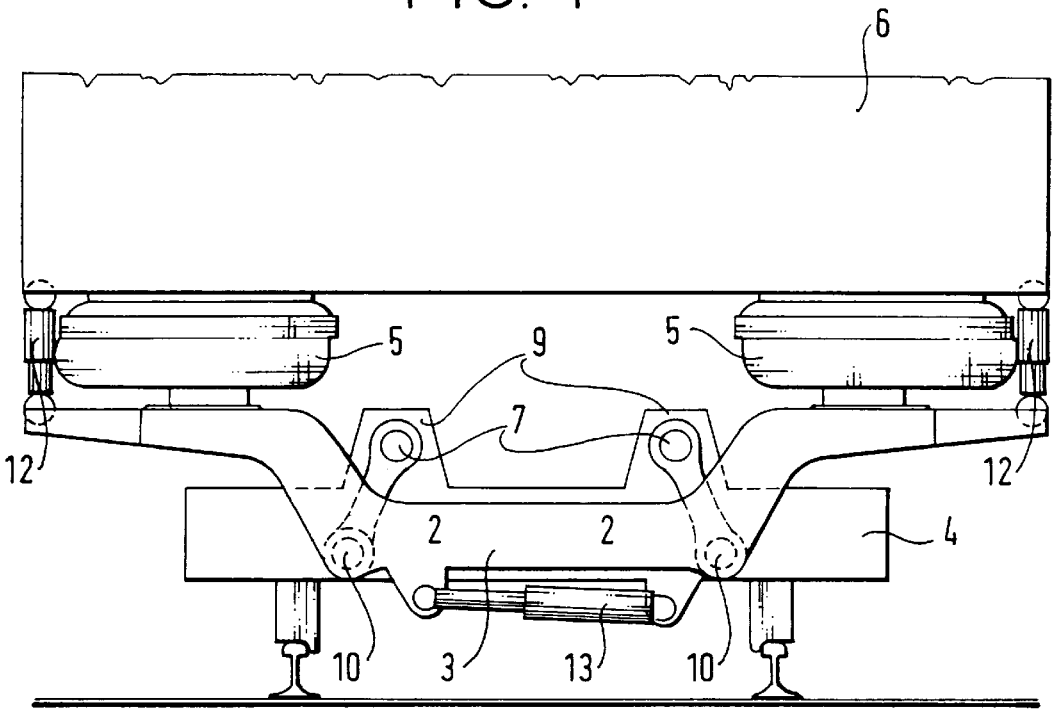
FIG. 4 is a front view, partially in section, of the first embodiment of the link tilt bogie of the invention.

In the first embodiment as shown in FIGS. 2 and 3, and more particularly as shown in FIG. 4, anti-yaw dampers 12 are disposed between the vehicle body 6 and the tilting cross-member 3, parallel to the secondary suspensions 5 with which they are associated.

Figure 5:
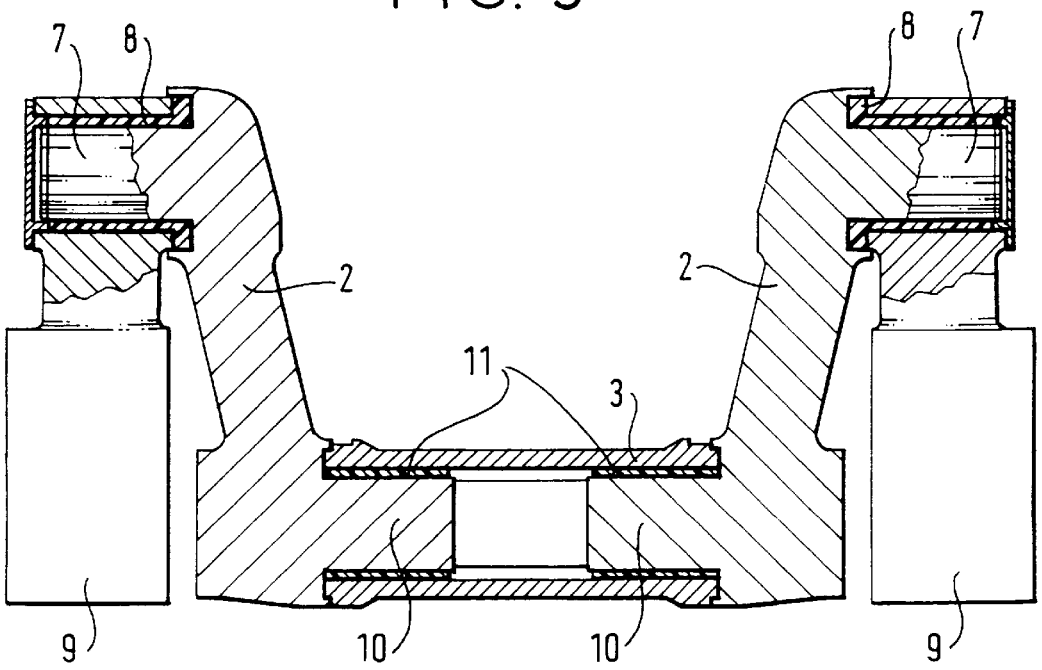
FIG. 5 is a side view in section of the first embodiment of the link tilt device of the invention.

FIG. 5 is a side view in section of the first embodiment of the link tilt device of the invention.

As described before, each link 2 of the link tilt device 1 of the invention has a top bearing 7 at its top end associated with a first reception element 8 for the top bearing, and has a bottom bearing 10 at its bottom end associated with a second reception element 11 for the bottom bearing 10.

The first reception elements 8 for the top bearings 7 are formed in the front and rear middle cross-members 9 of the bogie frame.

The second reception elements 11 for the bottom bearings 10 of the links 2 are implemented in the tilting cross-member 3.

Figure 6:
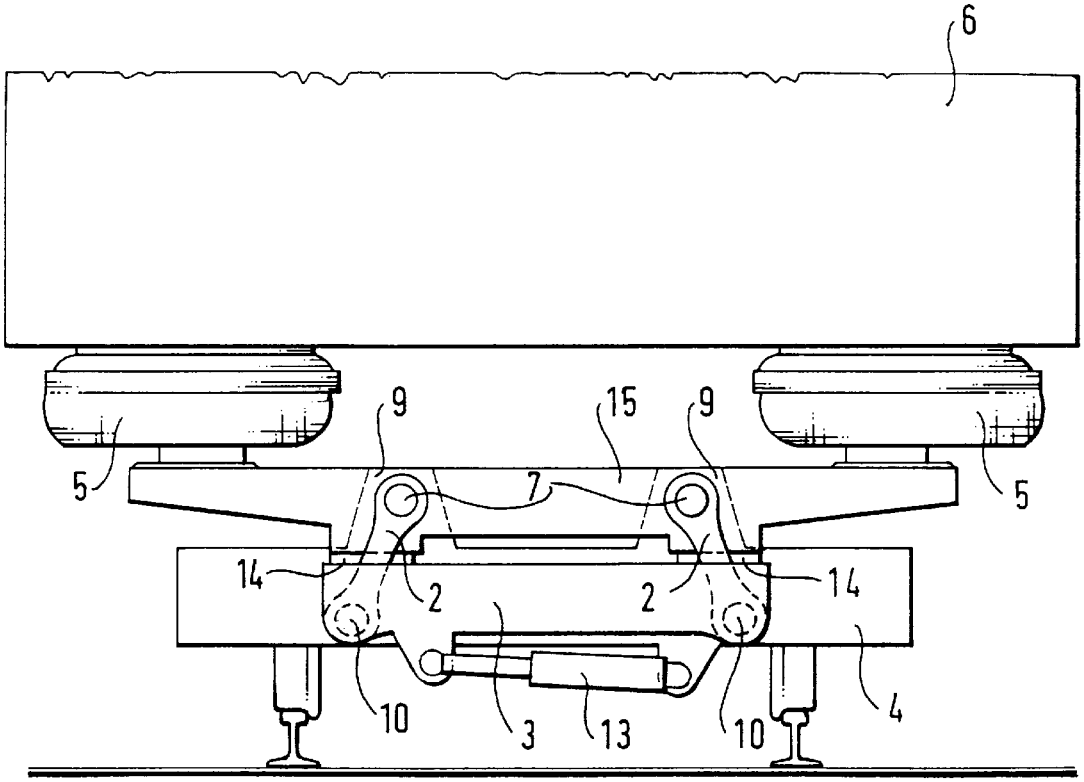
FIG. 6 is a front view in partial section of a link tilt bogie constituting a second embodiment of the invention.

FIG. 6 is a front view in partial section of the link tilt bogie constituting a second embodiment of the invention.

The link tilt device 1 of the invention is associated with a tilting cross-member 3.

The tilting cross-member 3 is suitable for being disposed in a bogie frame 4 in such a manner as to be suspended from the bogie frame 4 by means of the links 2.

Secondary suspensions 5 are disposed between an intermediate cross-member 15 and the vehicle body 6.

The links 2, the tilting cross-member 3, and the bogie frame 4 constitute, in the radial plane of the bogie frame, a trapezium of hinged rigid elements having a small base secured to the tilting cross-member 3, a large base secured to the bogie frame 4, and having sloping sides constituted by the links 2.

The links 2 are disposed obliquely and they converge.

As before, each link 2 has a top bearing 7 at its top end associated with a first reception element 8 for the top bearing, and at its bottom end it has a bottom bearing 10 associated with a second reception element 11 for the bottom bearing 10.

The first reception elements 8 for the top bearings 7 are made in front and rear middle cross-members 9 of the bogie frame 4.

The second reception elements 11 for the bottom bearings 10 are made in the tilting cross-member 3.

In this second embodiment, an intermediate cross-member 15 is disposed between the secondary suspensions 5 of the vehicle body and the tilting cross-member 3.

In addition, a friction block type element 14 is disposed between the intermediate cross-member 15 supporting the secondary suspensions 5 of the vehicle body and the tilting cross-member 3.

It is possible to implement such friction block type elements 14 because, as a result of the invention, the angular stiffness between the bogie frame and the vehicle body is a characteristic that is predetermined.

Whatever the embodiment, a control element 13 for controlling tilting compensation for insufficient cant is secured to the tilting cross-member 3 and to the bogie frame 4.

The present invention also provides a link tilt bogie including a link tilt device 1 as described above.

I claim:

1. A link tilt device for a tilting cross-member placed in a bogie frame so as to be suspended from said bogie frame by means of links, secondary suspensions being disposed between said tilting cross-member and a vehicle body, said links, said tilting cross-member, and said bogie frame forming, in the radial plane, a trapezium of hinged rigid elements having a short base secured to the tilting cross-member, a long base secured to said bogie frame and having sloping sides constituted by said links, said links being disposed obliquely and converging, wherein the middle cross-members of said bogie frame, said links, and said tilting cross-member form an assembly having a predetermined angular stiffness between said bogie frame and said vehicle body.

2. A device according to claim 1, wherein each link includes at a top end a top bearing associated with a first reception element from said top bearing that is made in a middle cross-member of said bogie frame, and at a bottom end a bottom bearing associated with a second reception element for said bottom bearing made in said tilting cross-member, for providing said predetermined angular stifftess between said bogie frame and said vehicle body.

3. A device according to claim 1, in which anti-yaw dampers are disposed between said vehicle body and said tilting cross-member, parallel to said secondary suspensions with which they are associated.

4. A device according to claim 1, in which an intermediate cross-member is disposed between the secondary suspensions of the vehicle body and the tilting cross-member in such a manner as to support said secondary suspensions, a friction block type element being disposed between said intermediate cross-member and said tilting cross-member.

5. A device according to claim 1, in which an element for controlling tilt compensation for insufficient cant is secured directly to said tilting cross-member and to said bogie frame.

6. A link tilt bogie, including a link tilt device according to claim 1.

* * * * *